US005713804A

United States Patent [19]

Socci et al.

[11] Patent Number: 5,713,804

[45] Date of Patent: Feb. 3, 1998

[54] BASEBALL BATTING AID

[75] Inventors: Roger Socci, Reston, Va.; Albert V. Yannella, Milford, Conn.; Thomas J. Dellipoali, Milford, Conn.; Stanley C. Wykowski, Milford, Conn.

[73] Assignee: Roger D. Socci, Reston, Va.

[21] Appl. No.: 286,830

[22] Filed: Aug. 9, 1994

Related U.S. Application Data

[63] Continuation of Ser. No. 591,371, Nov. 5, 1990, abandoned.

[51] Int. Cl.[6] ..... A63B 69/40

[52] U.S. Cl. ..... 473/422; 473/211; 473/268

[58] Field of Search ..... 473/422, 211, 473/268

[56] References Cited

U.S. PATENT DOCUMENTS

| | | | |
|---|---|---|---|
| 4,300,765 | 11/1981 | Stringham | 473/211 |
| 4,605,226 | 8/1986 | Morrissey | 473/211 |
| 4,826,165 | 5/1989 | Socci | 473/211 |
| 5,538,250 | 7/1996 | Putz | 473/268 |

*Primary Examiner*—Theatrice Brown
*Attorney, Agent, or Firm*—Armstrrong,Westerman,Hattori,McLeland & Naughton

[57] ABSTRACT

The present invention is concerned with a device for aiding the teaching and training techniques for hitting a baseball consisting of, a shirt to which is installed a flexible magnet within a tunnel to form a magnetic track which runs from the right front shoulder to the left front shoulder in an elliptical fashion; a baseball batting helmet with a chin strap attached thereto containing a magnetic sensor which contacts the magnetic track continuously as it travels from the right shoulder to the left shoulder as the batter swings at the ball; an alarm which notifies the batter of his position when he swings at the ball; an electrical power supply and means for connecting the power supply to the alarm and the magnetic sensor.

13 Claims, 5 Drawing Sheets

BASEBALL BATTING AID

This application is a continuation of Ser. No. 07/591,371, filed Nov. 5, 1990, now abandoned.

FIELD OF THE INVENTION

The present invention relates to a batting aid for baseball players. More particularly, the present invention relates to a device which aids in the training and teaching of hitting techniques in baseball.

BACKGROUND OF THE INVENTION

Numerous techniques have been developed to improve the ability of a player to hit a ball with a bat, club, racket or other implement. Generally, these techniques rely upon a repetitive practice routine of swinging at the ball. In the case of baseball players, batting tees, batting practice machine and pitchers have been used to improve a batter's swing and hitting ability. While these techniques have been useful, the degree of success with all players has not been particularly great. Further, relatively long periods of time are required with proper instructions to perfect one's ability through constant practice.

Numerous articles have also been published on methods for improving hitting. For example, *THE ART OF HITTING* by Charley Lau with Alfred Glossbrenner (1980) discloses the movement of the head during hitting. *THE SWING'S THE THING* by Ben Hines and Bob McBee (1985) teaches chin and shoulder movement, the fulcrum position, bringing the barrel of the bat in a downward plane into the baseball, and the turning of the head.

It has been well established in the apt that proper head to shoulder transfer and movement through the swing is critical in achieving solid contact with the ball in transferring maximum force so as to hit the ball as far as possible. U.S. Pat. No. 4,605,226 by Morrissey discloses a training device to be used in the sport of baseball and the like which enables the user to improve his hand-eye coordination and to maximize the head to shoulder transfer. The device of Morrissey is mounted on a protective helmet, said device comprising a shield having a top flange and a main opaque body releasably mounted on a protective helmet on the side opposite the source of the projectile travelling towards the user. In the case of baseball, the user's head being out of the desired position will result in a shielding of the eyes of the user from the projectile.

U.S. Pat. No. 4,300,765 by Stringham discloses a batting aid which is comprised of a shoulder piece for positioning on the shoulder of the batter, a jaw piece for positioning against the jaw of the batter and the means which connects the shoulder piece and jaw piece together in a spaced relation to each in order to impede movement of the jaw of the batter towards the shoulder during a swing.

The most recent development is disclosed in U.S. Pat. No 4,826,165 by Roger Socci wherein a device is disclosed which teaches a method for hitting a baseball. In Socci the batter is fitted with a cumbersome shoulder harness with a chin holder connected thereto in a manner to allow for movement of the chin holder on a plane from the right shoulder to the left shoulder in an elliptical fashion. Though Socci teaches a workable training module, the device itself, however, is impractical and cumbersome. The present invention teaches a more practical device for teaching the correct head movement in the process of hitting a pitched baseball. Continued development, however, is now common place.

It is therefore, an object of the present invention to provide a very simple device to teach baseball players the correct method for hitting a baseball.

Another object of the present invention is to provide a batting aid for a baseball player which will enable the batter to keep his head in the correct position and the proper positioning of his front shoulder when hitting a baseball.

A further object of the present invention is to provide a simple hitting device which can improve the hitting stance of a batter.

These and other object of the present invention will become more apparent as you proceed through the detailed description.

SUMMARY OF THE INVENTION

The present invention is concerned with a training device which can be worn by a user to teach the correct position when hitting a baseball, comprising: a shirt to which is installed a magnet within an adjustable magnetic track; a baseball helmet with a chin strap attached thereto and a magnetic sensor connected on said chin strap which contacts the magnet within the magnetic track on the shirt as the batter hits the baseball; an alarm; an electrical power supply of sufficient voltage to activate the alarm; and, means for connecting the power supply to the alarm and the magnetic sensor.

DETAILED DESCRIPTION OF THE INVENTION

Figure 1:
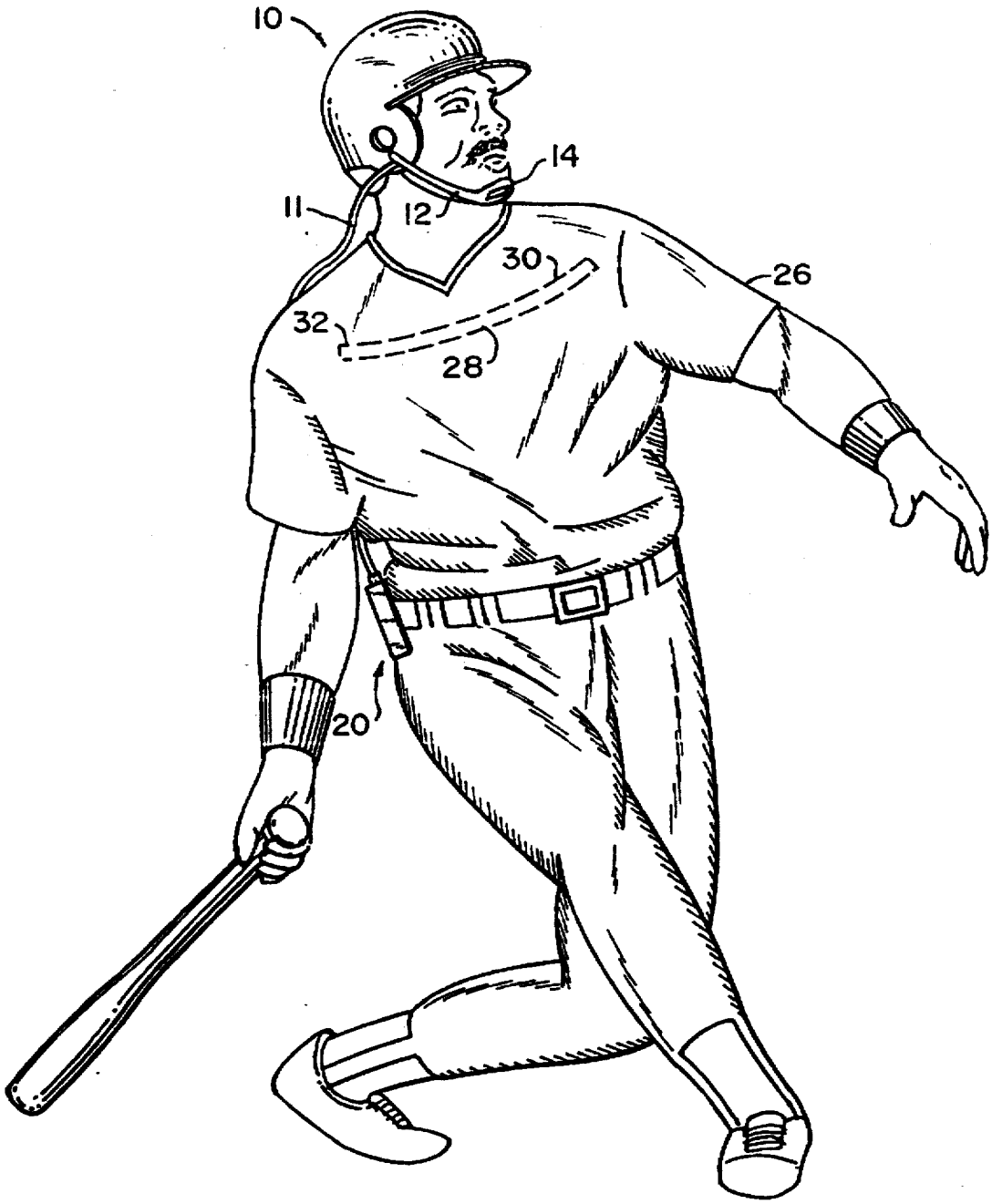
FIG. 1 is a perspective view of the batter fitted with a helmet containing a chin strap and magnetic sensor and a shirt containing a magnetic track as he swings.
Figure 2:
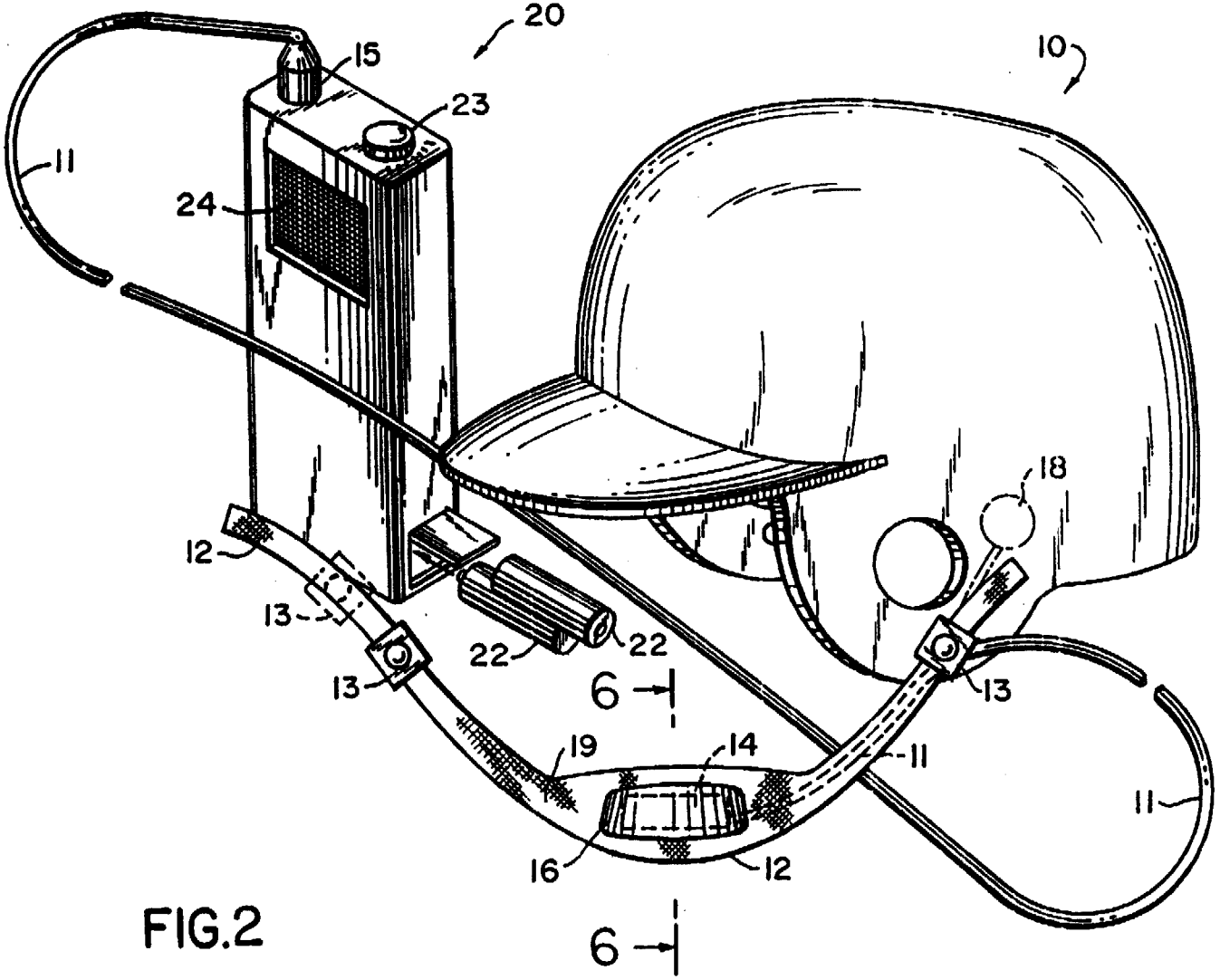
FIG. 2 is a perspective view of helmet, chin strap and alarm system.
Figure 3:
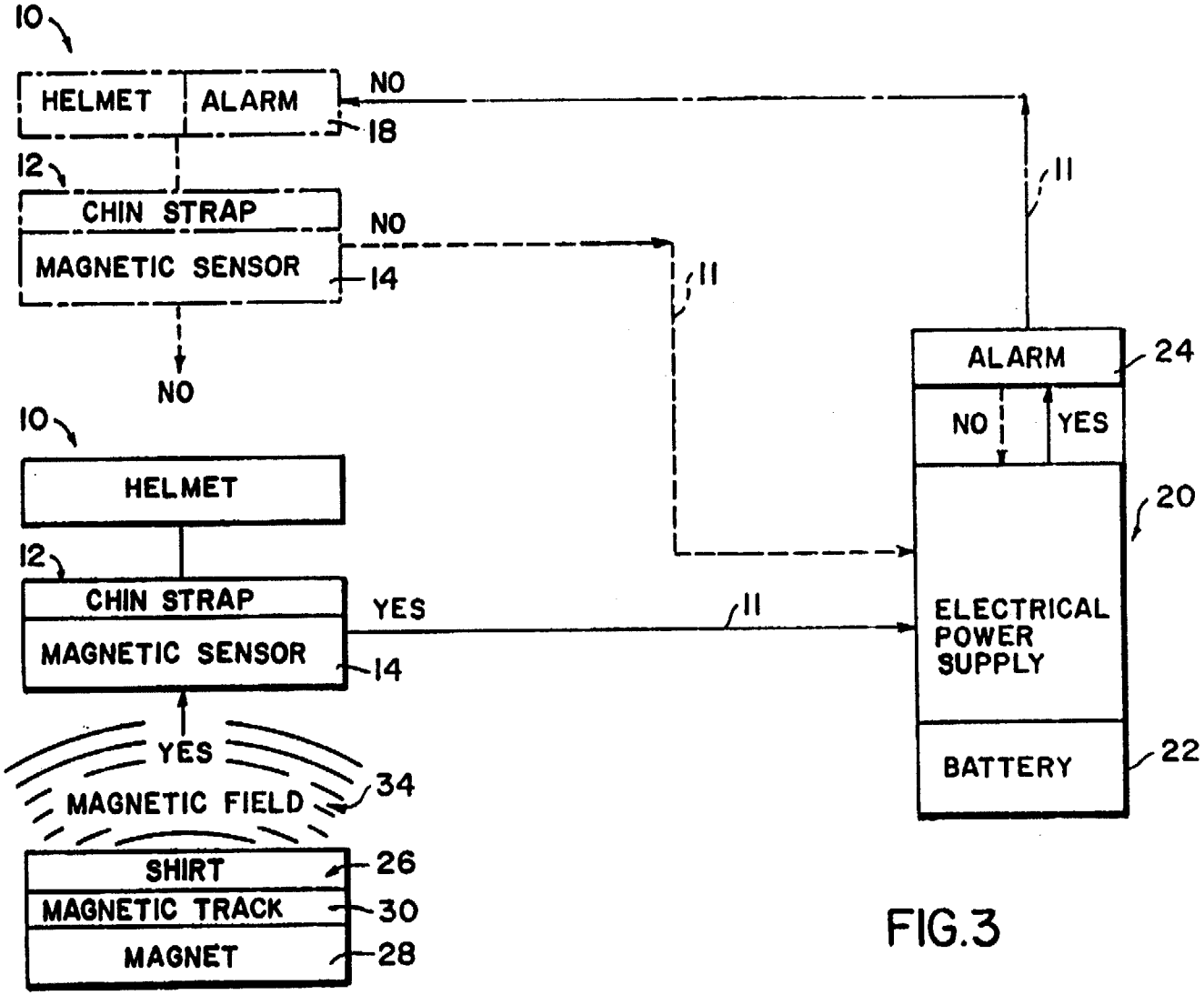
FIG. 3 is a view of the invention schematically shown.
Figure 4:
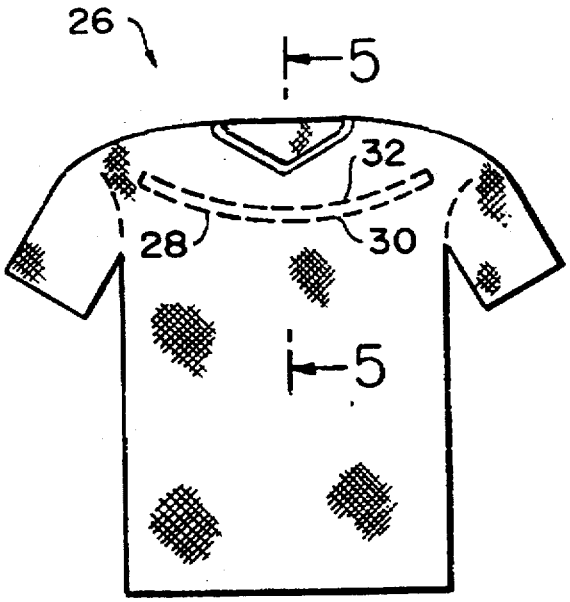
FIG. 4 shows the shirt with multiple magnetic tracks.

The present invention discloses a teaching and training tool for demonstrating a baseball player's proper head movement during the process of hitting a pitched baseball.

In addition to training the correct head movement during the process of hitting the pitched ball, the present invention further inadvertently teaches and trains the proper use of a batter's front shoulder in the hitting process.

The training device of the present invention comprises means for securing a medium of communication on the batter' thoracic section; means for securing a medium of communication on the batter's head section in a manner to communicate with the communication means on the batter's thoracic section; an alarming device; an energy source for the alarming device; and; means for integrating the energy source with the alarming device and the communication means of the head and thoracic section.

The medium of communication on the batter's thoracic section generally comprises a sensing device or a signal driver. By sensing device is meant a device which detects signals from a variety of sources. Suitable sensing devices includes but are not limited to, optical sensing devices, inductants, sound sensing devices, magnetic sensing devices, capacitance sensing devices, resistance sensing devices, conductants, radio waves, mechanical sensors and the like. It is preferred in the present invention to utilize a magnetic sensing device. A signal driver on the other hand is merely a device which sends a signal or causes a signal to be sent such as light, reflective surfaces, conductive materials, sound receivers, magnetic field, electrical field, pressure sensitive switches and the like. The preferred signal driver, however, is a magnetic field.

It should be understood in the present invention that the sensing device and the signal driver may be located on either the head portion or the thoracic portion. The location of either on the head or the thoracic portion is a matter of practicality. Typically, however, the sensing device is located on the head portion and the signal driver is located on the thoracic portion.

Typically, a batter is fitted with a head portion which is generally a baseball helmet 10 fitted with a sensing device 14 located around the area of the chin strap 12. This sensing device contact or communicates with a signal driver located on a shirt 26 or other clothing fitted on the thoracic section of the user. This signal driver would communicates with the sensing device to inform the user whether or not he has assumed the correct position during the hitting process.

For instance, when an optical sensor in utilized, the sensor emits a light which bounces off a reflector thereby sensing the distance between the sensor and the reflector. More particular, the sensing device is located on the chin strap of the batters helmet and the reflector is located on the batter's T-shirt. As the batter swings at the ball, the sensor senses the correct head and shoulder movement.

In the case of inductants, a self contained variable displacement transducer is utilized. This transducer consists generally of a coil with a iron core located in its center. In this embodiment, there is contact between the head portion and the thoracic portion. As the batter swings at the ball some type of device located on the chin strap of his helmet contacts and passes along a signal driver located in the shirt portion which senses the correct head and shoulder position.

Sound sensors may also be utilized. The sensor emits a sound wave and the signal driver detects this wave or visa versa. These sound wave are generally functional through all sound frequencies.

When a capacitance sensor is utilized, an electrical signal conductive material is located on the thoracic section or within the batter's shirt. As the sensor travels away from the conductive material there is a change in current. This change causes an alarm to go on or off thereby alerting the batter that he has not assumed the correct position.

Resistance sensors may also be utilized. In this instance a foil strain gauge is installed within the thoracic or shirt section. As the head portion contacts the foil strain gauge and put pressure on the foil, the resistance against the foil can be measured. This will in turn alert the user of the correct position by measuring the pressure that is exerted against the foil and the triggering of an alarm. The use of conductance sensors is similar to resistance sensors. In this instance, as the batters head travels during his swing at the ball a switch located on the thoracic or shirt portion would open or close as it contact the head section or helmet. This opening or closing of the switch would alarm the batter of the correct position.

Mechanical sensors may also be utilized. Mechanical sensors are generally linear variable displacement transducers or a rotary potentiometer. This sensor requires direct contact between the head section and the thoracic section. This sensor also detects the correct head and shoulder position and alert the batter.

Lastly, radio waves may be utilized. This includes all radio frequency sensing devices such a radar and the like. These waves covers all frequencies. Also, the circuits may be analog or digital. In this instance, like the light sensors, the radio waves measure the distance between the sensing device and the signal driver and alerts the batter as to his position.

Figure 5:
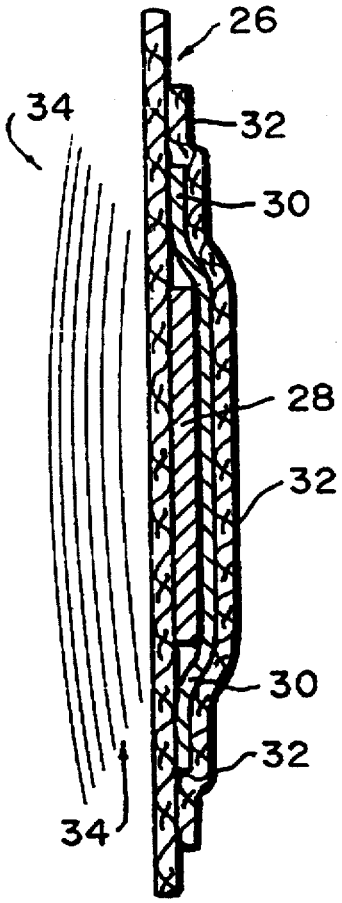
FIG. 5 shows a cross section of the shirt showing the multiple magnetic tracks.
Figure 6:
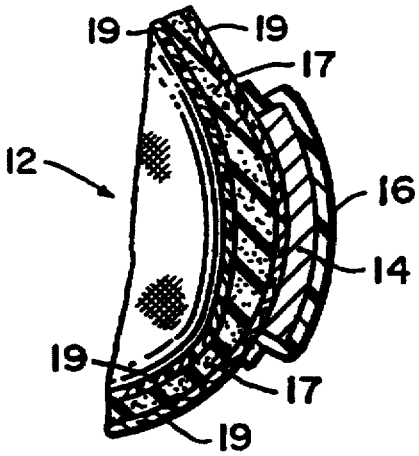
FIG. 6 shows a cross section of chin strap.
Figure 7:
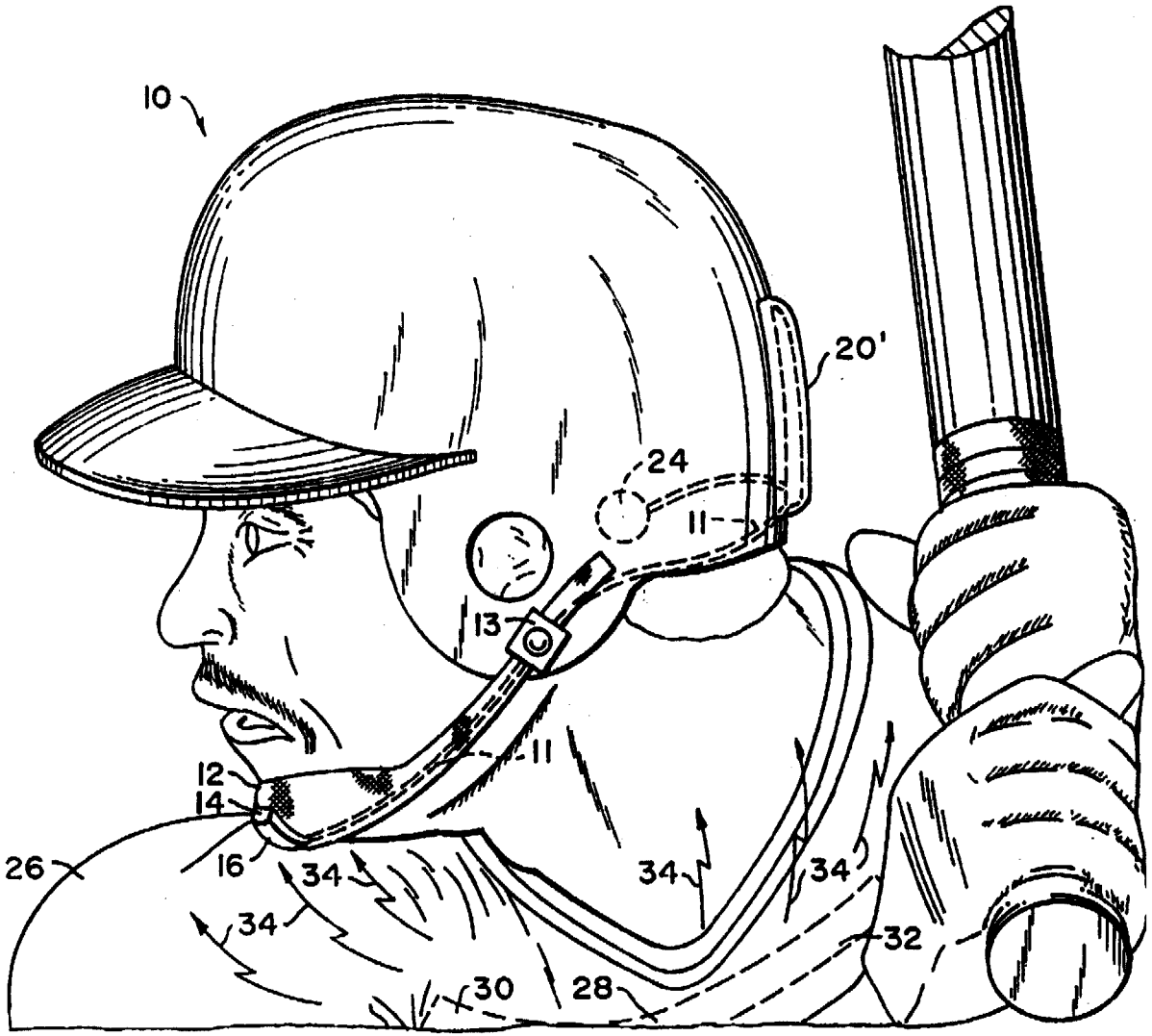
FIG. 7 shows optional embodiment of helmet showing correct shoulder and head location or position.

The preferred embodiment utilizes a magnetic sensor section located in the helmet section and a magnetic field section located on the shirt portion. Both sections function together to accomplish the objective of the present invention. To the shoulder section is contained means for securing an adjustable magnet which runs from the batter's right front shoulder to the batter's left front shoulder in an elliptical fashion or like an circular arc. The magnet is generally secured within a pocket or tunnel within the shirt to facilitate the sliding of the magnet in and out. While installed, the tunnel or pockets holds the magnetic captive in the desired elliptical or arc configuration. Optionally, the shoulder portion or shirt may have multiple pockets or tunnels (FIG. 5) positioned in parallel to accommodate different user sizes and shapes. To allow for movement of the shoulder section or shirt during use and to facilitate installation, the magnetic must be made of a flexible material. This flexible material, however, must exhibit sufficient magnetic properties. Suitable magnetic materials include any magnetic material which will energize a magnetic sensor such as the one located in the chin strap of the helmet section. Suitable magnetic materials include barium ferrite and strontium ferrite and preferably high energy barium ferrite encased in a thermoplastic natsyn or in a nitrile binder. It should be under stood, however, that the magnetic material or flexible binder should not be limited to those listed above. Any magnetic material or flexible binder which exhibits the desired magnetic properties is suitable.

The shirt section of the present invention can be made from any common and usual flexible shirt material provided, however, that it is constructed in a fashion to allow for an elliptical or circular arc across the front portion of the shirt to accommodate the magnetic material and to facilitate body movement by the user. Shirts such as T-shirts, sweat shirts, shirts made of elastic type material which is typically worn by baseball players and the like are suitable.

The second section of the present invention is the helmet worn by the baseball batter. The helmet utilized is similar to the helmet typically used by baseball batters. The helmet of the present invention, however, varies in the chin strap. The chin strap is designed to accommodate a magnetic sensor or magnetic switch. This sensor or switch senses the position of the batter's head and shoulder and informs the batter that he has or has not adapted the proper position. In essence, the magnetic sensor is a sensor in an electrical circuit. When this sensor comes into contact with the magnetic track, the circuit closes causing an alarm to go off which tells the batter that he is in the right position i.e. his head and shoulder is correctly position for hitting the ball. The circuit may also be connected in the opposite fashion wherein, as the sensor comes into contact with the magnetic track, the circuit opens causing the alarm to go on thereby telling the batter that his head and shoulder is in the wrong position.

To ensure continuous and repeated use, the magnetic switch or sensor is located in the chin strap under a protective shield. This protective shield is generally made of a rigid plastic. However, a protective shield made of any other flexible material may be utilized provided that the selected flexible material does not affect the magnetic field between the magnet within the magnetic track and the magnetic sensor. In most instance the shield section is what contacts the magnetic track and closes the circuit to set off an alarm which tells the batter that he is in the correct position. Both the chin strap and protective shield are fitted with adjustable means to accommodate different size individuals.

The magnet within the magnetic track and magnetic sensor in combination with an alarm device and an electrical power supply form an electrical circuit. The alarming device should provide sufficient audible intensity to notify the batter of his correct or incorrect position. This alarm should be located in a position which would make it easily audible by the batter yet not affecting the ability to correctly swing at the ball. Suitable areas include within the helmet, on the upper portion of the shirt or around the waist. The preferred location, however is within the helmet. The electrical power supply on the other hand maybe located on the helmet or at any other suitable location such as on the waist of the batter or in his pocket. When ever the power supply is located around the waist, it is connected to the rest of the circuit by an umbilical wire connection. Care should be taken to ensure that the umbilical wire connection does not affect the batters ability to hit the ball. Once the circuit is activated, the power supply should be of sufficient voltage to sound the alarm. Suitable voltage ranges from about 6 volts DC to about 12 volts DC and preferably about 9 volts DC.

During use, the batter is fitted with shirt 26. The shirt is fitted with magnet 28 which is installed into magnetic track 30, located into tunnel 32 which runs across the front of the shirt like a circular arc. The batter is then fitted with helmet 10 which has connected thereto chin strap 12 which holds the helmet in place on the head of the batter and can be adjusted to size by snaps 13. Fitted within the chin strap 12 towards its center is magnetic sensor 14 shielded by protective shield 16. The thin strap has an outer and inner cover 19 which protects a softer sponge-like material 17 to which magnetic sensor 14 is attached. Located and connected to the waist of the batter is electrical power supply 20 which contains and is powered by a 9 volts DC battery 22. The electrical power supply contains alarm 24 and a volume control 23 which turns the alarm up and down. Connecting the electrical power supply to the helmet is umbilical wire connection 11. This wire connection 11 is connected to the power supply by plug connector 15. The wire connection 11 then enters helmet 10 with the positive feed going to magnetic sensor 14 and the negative feed going to alarm 24' which can also be optionally located within the electrical power supply 20' located within the batter's helmet 10.

In the process of swinging at a pitched ball the batter's chin moves down and back in the correct path along magnetic track 30 causing contact between magnetic sensor 14 located within chin strap 12 and magnet 28 which extends elliptically across the batter's shirt. Upon contact, magnetic sensor 14 causes a continuous sound to be emitted from alarm 24 when the batter's chin moves along the correct position across magnetic track 30. If and when there is an incorrect head movement during the swing, magnetic sensor 14 ceases making contact with magnetic track 30 thereby opening the circuit and causing the alarm to stop. The stopping of the alarm notifies the batter that his head or shoulder or both are not in the proper position for the swing.

Optionally, the magnetic track may be fitted with a high energy magnet to create magnetic field 34. A high energy magnet can activate the magnetic sensor through an air space ranging from about ⅛ inch to about ½ inch and preferably about ¼ inch. To activate the sensor, the magnetic driving force must be strong enough to pass through the air space and the plastic shield which is generally about ¼ inch in thickness.

If the batter makes an incorrect head movement while swinging at the ball, one or both of his eyes will lose sight of the pitched ball, drastically cutting down on the effectiveness of his hitting. During the preparatory stance, the batter's head and chin should be towards his front shoulder with the magnetic sensor within the chin strap contacting the magnetic track. The batter's head and chin should move down on the swing and them up thereby finishing the swing on his rear shoulder. All of the time during the swing the magnetic sensor should be in contact or in close proximity with the magnetic track. The head of the batter should never stay on the front shoulder during the swing. The downward movement of the batter's head during the swing along the magnetic track enables the batter's eyes to remain focus on the ball until it contacts the bat.

What is claimed is:

1. A training device which can be worn by a user to teach the correct position when hitting a baseball comprising:

a) a magnet means securing said magnet to a batter's body in an elyptical fashion such that said magnet extends across the batter's chest from the left shoulder to the right shoulder;

b) a baseball batting helmet having a chin strap attached thereto and a magnetic sensor connected on said chin strap which contact said magnet running from said batter's right shoulder to said batter's left shoulder as said batter hits a baseball;

c) an alarm;

d) an electrical power supply of sufficient voltage to activate the alarm;

e) means for connecting said power supply to said alarm system and said magnetic sensor.

2. A training device according to claim 1 wherein the magnet is secured within a tunnel to form a magnetic track running from the batter's right shoulder to the batter's left shoulder.

3. A training device according to claim 2 wherein the magnetic sensor connected to the chin strap detects the correct position of the head and shoulder as it moves from the batter's right shoulder to the batter's left shoulder along the magnetic track and transmit a signal to the batter by means of the alarm as he attempts to hit the baseball.

4. A training device according to claim 1 wherein the magnetic sensor connected to the chin strap contacts the magnet continuously from the batter's right shoulder to the batter's left shoulder elliptically.

5. A device according to claim 1 wherein the magnet is a flexible magnet.

6. A device according to claim 1 wherein the magnet is secured within a shirt.

7. A device according to claim 6 wherein the magnet is secured within a tunnel on the shirt to form a magnetic track running from the right front shoulder to the left front shoulder of the shirt in an elliptical fashion.

8. A device according to claim 1 further comprising a magnetic sensor with a protective shield.

9. A device according to claim 1 wherein the voltage of the power supply ranges from about 6 volts DC to about 12 volts DC.

10. A device according to claim 9 wherein the voltage of the power supply is about 9 volts DC.

11. A device according to claim 1 wherein the power supply is connected to the alarm and the magnetic sensor by means of an umbilical wire connection.

12. A training device which can be worn by a user to teach the correct position when hitting a baseball comprising:

magnet and megnetic sensor means for securing said magnet to a batters body such that said magnet extends from a batter's right front shoulder to the batter's left front shoulder in an elliptical fashion, said magnet having sufficient energy to activate said magnetic sensor through an air space of up to one inch; a baseball batting helmet with a chin strap attached thereto said magnetic sensor being connected to said chin strap such that said air space between said magnetic sensor and the magnet is held substantially constant by the batter as said sensor is moved from the right shoulder to the left shoulder in an elliptical fashion thereby detecting the correct position of the batter's head and relative to his shoulder; an alarm; an electrical power supply of sufficient voltage to activate said alarm; and, means for connecting said power supply to said alarm and said magnetic sensor.

13. A device according to claim 12 wherein the magnet activates the magnetic sensor through an air space ranging from about 1/16 inch to ½ inch.

* * * * *